United States Patent [19]

Abraham et al.

[11] 4,142,922

[45] Mar. 6, 1979

[54] HIGH STRENGTH LOW ALLOY STEEL CONTAINING COLUMBIUM AND VANADIUM

[75] Inventors: John K. Abraham, Broadview Heights; Peter J. Vander Arend, Brecksville, both of Ohio

[73] Assignee: Republic Steel Corporation, Cleveland, Ohio

[21] Appl. No.: 874,560

[22] Filed: Feb. 2, 1978

Related U.S. Application Data

[63] Continuation of Ser. No. 727,126, Sep. 27, 1976, abandoned.

[51] Int. Cl.[2] ..... C22C 38/06; C22C 38/12

[52] U.S. Cl. ..... 148/36; 75/123 J; 75/124

[58] Field of Search ..... 75/124, 123 B, 123 J; 148/36

[56] References Cited

U.S. PATENT DOCUMENTS

| | | | |
|---|---|---|---|
| 3,674,570 | 7/1972 | Hallstrom et al. | 148/36 |
| 3,721,587 | 3/1973 | Allten et al. | 148/36 |
| 3,725,049 | 4/1973 | Satoh et al. | 148/36 |
| 3,997,372 | 12/1976 | Matas et al. | 75/124 |

FOREIGN PATENT DOCUMENTS

| | | | |
|---|---|---|---|
| 1007175 | 10/1965 | United Kingdom | 75/123 J |
| 1058146 | 2/1967 | United Kingdom | 148/36 |

OTHER PUBLICATIONS

Heitmann et al.; "Development of a Formable, Low Carbon Columbrium Bearing High Strength Hot Rolled Sheet Steel;" Soc. Aut Eng., 3/74.

*Primary Examiner*—Arthur J. Steiner

*Attorney, Agent, or Firm*—Cooper, Dunham, Clark, Griffin & Moran

[57] ABSTRACT

High strength low alloy steels, produced as strip or the like by hot rolling, permit unusual economy of alloying ingredients while achieving superior mechanical properties. With a composition containing specifically low carbon and low manganese, and moderate proportions of both columbium and vanadium, preferably with no requirement of silicon. Yield strengths in a range to and above 80 ksi are attainable depending on the total of columbium and vanadium, and excellent properties of toughness and formability are exhibited in transverse as well as longitudinal directions without adding special sulfide shape control agents. Processing conditions, for hot rolling and coiling, can be selected over wide temperature ranges, for convenience of control, e.g. to achieve product uniformity. Rolling load requirements are acceptable and can be reduced to facilitate production of thin strip by reducing the ratio of columbium to vanadium, without impairing the way in which columbium appears to effectuate superior realization of the strengthening effect of vanadium in those compositions.

8 Claims, No Drawings

HIGH STRENGTH LOW ALLOY STEEL CONTAINING COLUMBIUM AND VANADIUM

This is a continuation, of application Ser. No. 727,126 filed Sept. 27, 1976, now abandoned.

BACKGROUND OF THE INVENTION

This invention relates to high strength, low alloy (HSLA) steels, having low carbon content and having good mechanical properties, i.e., by tensile and toughnes measurements, and likewise in respect to ductility and formability, for instance in exhibiting the ductility required for bending. The invention is particularly concerned with steel products which can be of the nature of sheet or the like, achieved by hot deformation; the contemplated products are thus made by hot rolling to desired thicknesses and shapes, notably strip, which can be used as so produced or as subsequently further reduced by cold rolling to sheet form, i.e., strip or the like, of thinner gauge.

The present improvements are notably designed to afford a steel of very low carbon content, with excellent properties in both longitudinal and transverse directions in reference to hot rolling. The steels are in the broad category defined by yield strengths of 60 ksi (60,000 pounds per square inch) and above, and for convenience of subclassification can be designated as steel products in the several respective ranges of 60–70 ksi, 70–80 ksi, and 80 ksi and higher. Indeed, a special aspect of the present invention resides in the provision of new and improved high strength low alloy steels, particularly as hot rolled strip, having yield strength of 80 ksi or better, preferably up to 85 ksi.

The demand for steel products of the nature described above rests to a considerable extent on increasing need for high strength in steel strip, sheet and the like, with a minimum of weight and, understandably, at as little cost as possible. For example, steels of this nature have many uses in vehicle constructions, particularly in the automotive area where for fuel economy it is desirable to reduce the weight of the structure, yet without impairing strength.

A basic purpose of HSLA steels of this class is therefore to achieve high strength properties, with a minimum of alloying elements and a minimum of processing expense. At the same time, however, it has been difficult to obtain satisfactory products in a variety of respects without employing a number of special elements for different purposes. Thus, high tensile properties and toughness can be obtained with additions of certain elements to steels of moderate to high manganese content and moderately low carbon, but avoidance of directionality in some of these properties, such as toughness and bendability, has usually required further additions, exemplified by rare earth elements, as well (in some cases) as special desulfurization.

Not only have the further additions, just mentioned, contributed to the cost of the described steels, but there appears to have been room for improvement in cost reduction even as to the quantity of other elements included. With previous efforts toward economy, useful HSLA steels have been difficult to attain at the higher strength levels and with realization of practical characteristics, e.g. such as non-directionality, good toughness, and good weldability of the ultimate products. Attention is also needed to the problem of convenience in processing these steels, in hot rolling operations. In many cases of previous lower-cost HSLA compositions, very careful control has been required for finishing temperatures, coiling temperatures, and the like, within narrow ranges. Likewise, it has appeared that hot rollability is not always as good as might be desired, particularly in that some strength-promoting or other elements of the composition are believed to stiffen the hot band during hot rolling; if possible, there has been a need to reduce the hardness factor, as explained below, exhibited by the higher strength steels in such rolling operations.

SUMMARY OF THE INVENTION

For the above and other purposes, and notably for attainment of high strength low alloy steel products having superior properties and yet characterized by economy of cost and ease of processing, the invention, in an important aspect, consists of steel characterized by additions of the microalloying elements columbium and vanadium in low to moderate amounts, with critical, very low content of carbon the above elements and also maximum values for normal minor elements such as sulfur, nitrogen, phosphorus and aluminum being as given hereinbelow, a paramount feature of the invention is the attainment of desired strength and toughness in an unusually lean alloy, with respect both to the so-called microalloying metals and to elements such as manganese and silicon.

In the new compositions, a first significant discovery is that the microalloying elements Cb and V can be employed with unusual effectiveness in a composition having a very low carbon content, e.g. not more than 0.06% (all percentages herein being by weight), and a low manganese content, being not above 0.6%, preferably not more than 0.5% and very preferably less than 0.5%. At these levels of carbon and manganese, it has been found that unusually high yield strengths are attainable with relatively moderate additions of columbium and vanadium. In particular, it is found that the effectiveness of vanadium as a strengthening agent can be greatly enhanced in the presence of a minimum amount of columbium, even at low levels of nitrogen, such as less than 0.005% (weight percent). In other words, the strengthening effect of vanadium is greater than might be expected on the basis of much of the prior art.

A more specific finding is that in the new compositions, the yield strength is directly related to the sum of the percentages of these two elements Cb and V. Thus in the stated compositions, with the total of columbium and vanadium at minimum percentages of 0.07, 0.13, 0.17 and 0.22, it is possible to obtain minimum yield strengths (e.g. in both directions) of 60, 70, 80 and 90 ksi, respectively, in the hot rolled products. Moreover, there appears to be a maximum columbium level above which no further increase in strength occurs. This Cb level is related to the solubility of Cb (C, N) in austenite. Although reduction of the carbon content to levels herein contemplated, as for example to about 0.04%, does increase the solubility of Cb, the maximum useful Cb level is indicated to be about 0.15%.

A second important aspect of the invention is that with the stated microalloyed compositions, especially having the prescribed or preferred levels of carbon and manganese, and with very little silicon, the rolled products are found to exhibit outstanding transverse formability and toughness without special additions or processing. Heretofore in high strength low alloy steels, such properties have been markedly less satisfactory in the transverse direction (crosswise of the direction of rolling) than in the longitudinal or lengthwise direction of the rolling path. To correct such disparity, especially in strip materials having yield strengths of 60 ksi and over, so-called sulfide shape control additives exemplified by rare earths or zirconium, which increase the cost, have been used, and alternatively or in addition, the molten steel has been subjected to desulfurization, another item of expense. In the present steels, all of such expedients can be avoided, with consequent savings of cost, and the omission of the shape control agents greatly enhances the surface quality of the strip product. It does not necessarily appear that there is a specific control of sulfide inclusions (in the sense of providing inclusions which are essentially nonplastic in rolling), as that there is an effective improvement in transverse toughness and formability without need to be concerned about inclusions.

One test of bendability is by press-brake forming to a sharp internal angle such as 60°, for determining the minimum inside radius of bend attainable without cracking, for example without edge cracking of cold-sheared specimens. The radius can be determined as a function or multiple of the specimen thickness T, such as 1T, 2T, 3T, etc. The products of this invention achieved a bend at least as sharp as a radius of 1T (both directions) at the 70 ksi strength level and 2T at the 85 ksi strength level. Toughness is determinable with suitable Charpy V-notch (CVN) tests, conveniently using half-size CVN samples. With such tests, the so-called shelf energy ratio of the transverse-to-longitudinal directions for the higher strength materials of low alloy type heretofore available is normally less than 0.30 in the absence of sulfide shape control agents, but in all of the steels of this invention, such ratio is greater than 0.45.

This advantage of improved transverse properties is effectively attained in steels up to 0.06% carbon — e.g. in the range 0.04 to 0.06%, with manganese not over and indeed specifically below 0.5% (e.g. 0.3 to 0.45%); it also appears to be realized at somewhat higher levels of Mn, up to 0.6%, if carbon is kept quite low, e.g. 0.03 to 0.04%, preferably below 0.04%.

As indicated above, a third attribute of the invention, notably in its preferred embodiments, is a very low total alloying content, with correspondingly lower overall cost of the final product in comparison with prior, formable steels of like high stength and so-called low alloy type. Thus, for example, advantageous ranges of total alloy elements (Mn, Si, Cb and V) in the present, relatively lean steels are 0.40 to 0.79% for 60 ksi minimum, 0.45 to 0.83% for 70 ksi minimum, and 0.51 to 0.90% for 85 ksi minimum, whereas a number of prior HSLA steels have required substantially higher totals, e.g. 1.0 to 2.0% or more for 80 to 85 ksi minimum products.

A fourth aspect of these improved steels, partly indicated above in reference to transverse properties, is a significant improvement in toughness and bendability, e.g. in both directions, in comparison to various prior 60 to 80 ksi HSLA steels that have been regarded as normal, especially in the lower strength levels. This comparison is of special significance in view of the commonly much higher contents of C (e.g. approaching or at 0.10%) and Mn (as from 0.9 to 1.5%). Moreover, as above stated, the shelf energy anisotropy $CVN_t/CVN_l$, being the transverse-to-longitudinal ratio, is significantly greater than 0.4; for example, such ratio is 0.62 for a steel of this invention having 0.044% C and 0.30% Mn (with 0.02–0.07% Cb and 0.02–0.05% V) that attains 60 ksi yield strength and minimum bend of ½ T, and has a transverse CVN impact test of 28 ft.-lbs. at 70° F. on half-size specimens.

In contrast with prior use of higher carbon and especially, higher manganese levels in HSLA steels, it is now found that neither C nor Mn is needed, at such levels, either for solid solution strengthening or for lowering the transformation temperature to promote fine ferrite grain size.

The steels of the invention are found to have considerably better hot rollability than usual 60 to 80 ksi HSLA strip products, allowing better gauge control and attainment of thinner gauges. This property is conveniently represented by the hardness factor, being the stiffness of the hot strip during rolling relative to plain carbon steel; a lower hardness factor thus indicates improved hot rollability. Although it is known that columbium additions (while of advantage in improving grain refinement) stiffen the hot band during hot rolling, and there might be slightly better rollability with lower Cb, it has now been found that a very significant reduction in hardness factor is obtainable with the low-C, low-Mn, Cb-and-V steels of this invention, as compared with prior 60 to 85 ksi products — indeed reaching hardness factors about as low as previous 50 ksi steels.

Finally, the new products as defined are found to permit a broad range of processing conditions, i.e., as to finish temperature for the hot rolling sequence, and as to coiling temperature for the completed strip. Whereas many steels of this class have been highly sensitive to finishing and coiling temperatures when it is sought to process them to a selected, specific, high yield strength, the present steels achieve target values (or better) in yield strength over a wide range of finishing temperature, e.g. 1550° to 1750° F. and coiling temperature, e.g. 1100° to 1350° F. In consequence, practical production of these alloys on a hot strip mill is facilitated, especially through a wide range of thicknesses, as from 0.07 inch to 0.5 inch. Attainment of uniform properties throughout each coil is also greatly enhanced.

Briefly summarized so to broader ranges of composition, the new products contemplate a hot rolled steel product, e.g. so reduced by at least about 50%, which contains: over 0.02% to 0.06% carbon, advantageously 0.03 to 0.06% C; 0.3 to 0.6% Mn, preferably below 0.5%, unless carbon is very low, e.g. below 0.04%; silicon less than 0.2%, very preferably 0 to 0.1% Si; 0.02 to 0.15% Cb, preferably not more than 0.12%, and very advantageously not above 0.10% Cb; 0.02 to 0.20% V, conveniently not higher than 0.17% V; and total Cb + V, 0.07% and above, depending on required yield strength, but usually not more than about 0.25% even for 85 ksi.

The steels also preferably contain not more or less than certain amounts of minor elements, as for example 0.01% min. Al, 0.03 max. sulfur, and 0.03 max. phosphorus. Ordinarily, sulfur can be not less than 0.025% (a preferable maximum) without special de-sulfurization, and as indicated, such treatment is not ordinarily required for achieving nondirectionality in the present steels. In practice, it appears that sulfur content may conveniently range from 0.008 (or less) to 0.02%, aluminum from 0.02 to 0.07%, or up to 0.09%, and phosphorus from less than 0.01 to 0.015%. While nitrogen content may range as high as 0.025%, an advantage of the invention is that ordinarily, special provision for nitrogen need not be made, and full advantages can be expected with nitrogen in the range of 0.007% and below, e.g. to 0.003%. The steel is very preferably aluminum-killed — such operation being performed in conventional manner and for conventional purposes.

DETAILED DESCRIPTION

The steels of the invention having compositions within the ranges stated above, or indeed within more specific ranges related to particular and notably advantageous aspects of the invention, are prepared in an essentially conventional way, e.g. for making a very low carbon, low alloy steel, following known practices for producing a clean ingot product, with good control of desired contents of small percentages of alloying elements. Thus the basic melt is achieved in a customary manner, as in a standard electric or basic oxygen furnace, appropriate attention being paid to the desired low carbon content. It is understood that carbon levels as low as 0.03% or slightly lower are effectively obtainable without special treatment of the melt after tapping, and indeed the carbon ranges contemplated as preferred for the present steels appear to pose no special problem in melting practice.

Additions of the several required elements to the basic charge of scrap, iron and the like are made in the manner appropriate for such materials. To the extent that the desired low level of manganese is not inherently present in the charge, this element may be added in the furnace and/or ladle, e.g. as ferromanganese. Very preferably the minor, i.e., microalloy additions, Cb and V, are effected by adding appropriate material, for example as ferroalloys, to the melt in the ladle after tapping. There is ordinarily no need to add silicon or, as explained above, to introduce additional nitrogen into the melt.

It is greatly preferred that the steel compositions of the invention be fully de-oxidized; although other de-oxidation practice may be used, satisfactory results are achieved by the usual killing with aluminum. Thus aluminum can be added to the ladle for de-oxidizing so that oxygen is reduced to values, for example, less than 0.005%.

After pouring the steel of the melt, which has been suitably controlled as to content of the several required elements, the resulting ingots are handled in conventional way, being reduced to slab or the like for final reduction by hot deformation. For most purposes, this is effected by hot rolling, for example through the requisite number of passes, to a selected finish temperature. A special advantage of the invention is that this finish temperature may be chosen over a wide range, for example from 1550° to 1750° F. (or conceivably as high as 1800° F.) without particular regard to the precise composition as to microalloy elements or as to the precise minimum yield strength desired. It appears that increase of yield strength with increase of finish temperature is not of great or practical significance over the stated range.

The product delivered by the hot mill at the selected or determined temperature within the above range, being strip or other shape as sheet or the like, is appropriately cooled to a selected temperature. Such cooling may be at a rate of 15° to 135° F. per second (with air, or with water spray or jet if needed), in accordance with known procedure for these types of steel. The selected temperature to be reached thus for coiling or other collecting of the hot-rolled material (including piling of sheets) may be in the range of 1100° to 1350°, or even up to 1400° F. After such collection, e.g. after the coiling of strip, the product can be allowed, in usual fashion, to cool very slowly. As in the case of the finish temperature, this coiling temperature may vary within the range (especially above 1100° F. and below 1350° F.) without substantial effect upon, or other than very minor relation to, the desired yield strength of the product; strength properties are thus determinable essentially wholly by the elemental composition. In fact, a valuable aspect of the invention is that at prescribed levels of carbon and manganese, and with both elements Cb and V present, in amounts of at least 0.02% of each, the strength properties of the product are primarily determined by the total quantity of these microalloying elements.

The improved high strength, low alloy steels can be produced, as hot rolled product, in a usefully wide variety of gauges, for instance from about 0.05 to 0.5 inch. Although the middle part of the range, say from about 0.1 to about 0.25 inch, may have considerable utility, a feature of the invention is the availability of the product to be hot rolled to a very reduced thickness in the above broad range, particularly including the very thin gauges.

It is conceived that some adjustment of composition, in the sense of less percentages of columbium and correspondingly greater percentages of vanadium, nevertheless within the individual and total ranges for these elements, may be useful for best rolling results at lower, and perhaps also at upper, values of thickness in the above-described total range. Thus, at the very thin gauges, the increase of vanadium relative to columbium provides better rollability, with less stiffening and particularly with lower rolling load requirement. Indeed the availability of such compositions is a feature of the present invention, affording extension of feasible thickness range for the products. At the very heavy gauges, it may also sometimes be desirable to decrease the proportion of columbium and increase that of vanadium so as to avoid excessive stiffness of the produced hot band and thus facilitate coiling and uniformity of gauge.

The products have been extensively tested throughout a significant range of compositions, with experimental results fully supporting the properties and characteristics described herein. A considerable number of tests involved heats in an induction heated furnace suitable for pouring 100-pound ingots, under laboratory operation. The base chemistry of the material produced was about that of SAE 1006-grade steel with very low phosphorus and sulfur levels, the specific content of elements being as indicated below. These laboratory heats were air-induction melted and were fully de-oxidized with aluminum prior to pouring into the 100-pound ingots.

The ingots were hot reduced and ultimately processed by hot mill rolling, in the manner of hot strip production, i.e., yielding, after a series of passes, a product of thickness of the order of 0.1 inch. Finish temperatures for the hot rolling were varied between 1550° and 1750° F. Although somewhat higher strength properties were achieved at the higher finish temperatures, the difference was generally small, to the extent that in most cases, values throughout the range can be used as may be convenient, without failing to achieve a selected minimum target strength in a practical sense.

In these tests, the strip samples were cooled at a rate of about 40° to 50° F. per second to a selected coiling temperature, and were thereafter collected at such temperature, by coiling or in a manner to simulate coiling. These collecting temperatures were varied over a range of 1000° to 1340° F., it being found that variation in properties was relatively small over a wide range, e.g. approximately 1100° to 1350° F.

Specimens from the several experimental products, i.e., after the completed strip had cooled to room temperature, were subjected to tests of mechanical properties, as will be understood from reports of such tests herein. Unless otherwise indicated, it will be noted that in all cases, yield strength was tested as the conventional 0.2% offset determination, in the longitudinal direction of the sample. Inasmuch as yield strength is almost invariably lower in the longitudinal than in the transverse direction, the determinations of yield strength can be considered to represent values at least as high as are found in both directions of the rolled product. Tests of impact strength and of bendability were made in conventional ways as elsewhere herein explained.

A number of steel compositions were produced in the foregoing manner, of which significant examples are set forth in the following table I:

TABLE I

| Steel No. | C | Mn | Si | Cb | V | Al | Cb+ V |
|---|---|---|---|---|---|---|---|
| | (values in weight percent) | | | | | | |
| 1 | 0.04 | 0.38 | 0.06 | 0.035 | 0.06 | 0.01 | 0.095 |
| 2 | 0.04 | 0.39 | 0.05 | 0.03 | 0.09 | 0.01 | 0.12 |
| 3 | 0.045 | 0.40 | 0.06 | 0.04 | 0.11 | 0.02 | 0.15 |
| 4 | 0.046 | 0.40 | 0.06 | 0.038 | 0.15 | 0.01 | 0.188 |
| 5 | 0.049 | 0.41 | 0.06 | 0.071 | 0.15 | 0.02 | 0.221 |
| 6 | 0.046 | 0.40 | 0.05 | 0.10 | 0.15 | 0.01 | 0.25 |
| 7 | 0.04 | 0.37 | 0.05 | 0.09 | 0.06 | 0.01 | 0.15 |

These have been identified, solely for reference herein, by the consecutive numbers in the left-hand column. In all cases, the content of phosphorus was less than 0.008%, the sulfur content was about 0.008%, and nitrogen was about 0.005%; as will be understood, the balance of the compositions consisted of iron and incidental impurities. These steels were all, of course, aluminum killed. Other tests demonstrated that the sulfur content was not critical in most cases and could go up to 0.02% or in some cases even 0.025% without introducing undesired directionality in the properties of toughness and formability. Although phosphorus and nitrogen contents up to 0.03% of each could be tolerated, good practice and emminently satisfactory results were had with low values of each of these elements, i.e. a maximum P of about 0.015% and of N about 0.01%.

The total of columbium and vanadium for each of the above heats is also listed, and it was found that the strength category, i.e., in yield strength, of the several heats could be directly correlated with the microalloy total. Thus heat No. 1 afforded yield strength above 60 ksi, while heats Nos. 2, 3 and 7, being upwards of 0.12% total microalloy elements, exhibited yield strengths of 70 ksi and above, i.e., in the range below 80. Finally, heat No. 4 afforded 80 ksi yield strength or better, while heats Nos. 5 and 6 exhibited strengths in a higher part of the range above 80 ksi, specifically values of 85 or more.

All of these steels showed good properties of toughness and formability, with a high ratio of transverse-to-longitudinal toughness measurement. The measured properties were essentially as indicated elsewhere herein for these products, the actual toughness values being at least comparable to those of prior HSLA steels and the above-mentioned ratio being substantially over 0.4, and indeed commonly at least 0.6. Transverse bendability was very good, ranging from ½ T for 60 ksi product, through 1T for 70 ksi material, going no higher than 2T for 85 ksi steel.

Other examples of steels embodying the present invention are set forth in the following table, it being understood that the content of silicon was very low, e.g. not more than 0.05%. In each case, maximum values were 0.009% P, 0.020% S, and 0.06% Al.

TABLE II

| Steel No. | C | Mn | Cb | V | N(approx.) | Cb + V |
|---|---|---|---|---|---|---|
| 8 | 0.05 | 0.40 | 0.10 | 0.12 | 0.006 | 0.22 |
| 9 | 0.05 | 0.40 | 0.02 | 0.10 | 0.006 | 0.12 |

In these steels of Table II, No. 8 represents a product exhibiting yield strength over 80 ksi, with good toughness and bendability in both directions, while steel No. 9 is a product of 70 ksi category, especially designed for rolling to very light gauge, e.g. below 0.09 inch. As will be noted, the relative proportion of vanadium to columbium is greatly increased, with corresponding, greater ease of rolling, to justify the slightly greater cost.

As has been explained, the total of the microalloying elements columbium and vanadium governs the strength properties of the product, and there appears to be some synergism between these elements in these particular steels, in that increments of vanadium exhibit greater increments of yield strength when columbium is present, than in corresponding steel compositions lacking columbium. Hence there is unusual advantage to the combination of these elements in the present alloys, with carbon and manganese in extremely low amounts.

As indicated, manganese is commonly kept below 0.5% in order to achieve the improvement in transverse properties, especially if carbon is 0.04% or higher, i.e., to 0.06%. Indeed, it is preferred that manganese be kept no higher than 0.45% under these circumstances. On the other hand, if carbon is reduced below 0.04%, it appears that amounts of manganese can be used, e.g. above 0.5% and even to 0.6%, preferably with some assurance that sulfur is relatively low, e.g. below 0.02%. Thus good transverse properties are indicated to be attainable with carbon at 0.03% and manganese at 0.6%.

The minimum totals of columbium and vanadium for obtaining at least 60 ksi yield strength are about 0.07%, for 70 ksi at least about 0.12% (preferably 0.13%), and for 80 ksi, the total should be at least 0.17% and preferably a little higher, e.g. 0.18%.

The alloys attain unusual advantages, particularly in mechanical properties and lack of directionality, with notably low expense and ease of processing. The products, moreover, have good surface properties and are capable of satisfactory welding, e.g. by spot welding and in other ways. Yield strengths above 80 ksi are readily attainable; indeed, the compositions disclosed herein for such purpose can be considered as a special area of the invention. For such products, it is preferable, especially to reach 85 ksi or better, that the carbon content be at least about 0.045%, or even 0.05%, in order to assure availability of conversion to carbides of columbium and vanadium, as may be desired for realizing the strength characteristics of these elements. As indicated, the silicon content of all the above examples of the invention is very advantageously quite low, but it is conceived that some high strength products in the 60-ksi and 70-ksi categories may constitute new and useful compositions even with silicon up to 0.4%.

Although the steels are conveniently defined by their properties as produced by the hot rolling, coiling and cooling procedure, it will be understood that an ultimate product embodying a steel of the invention may have had further processing that affects the value of a property, for example decrease in yield strength upon cold rolling and annealing.

It is to be understood that the invention is not limited to the specific features herein set forth for example but may be carried out in other ways without departing from its spirit.

We claim:

1. A high strength steel product produced by hot rolling and so produced, having yield strength of at least 80 ksi, transverse and longitudinal bendability each with inside radius of bend at least as small as 2T, and transverse-to-longitudinal CVN impact strength ratio greater than 0.45, said steel being aluminum-killed and consisting essentially of 0.03 to 0.06% C, 0.3 to 0.5% Mn, 0.02 to 0.15% Cb, 0.10 to 0.20% V, 0 to less than 0.2% Si, the total of Cb and V being at least 0.18%, 0.01 to 0.2% Al, and from 0 to the following maximum percentages of the following elements: 0.03 max. P, 0.03 max. S, 0.025 max. N, balance iron and incidental elements.

2. A steel product as defined in claim 1, which contains 0.045 to 0.06% C and 0.3 to 0.45% Mn.

3. A steel product as defined in claim 2, which contains from 0 to the following maximum percentages of the following elements: 0.015 max. P, 0.01 max. N.

4. A steel product as defined in claim 1, which contains 0 to 0.1% Si and 0.01 to 0.09% Al.

5. A steel product as defined in claim 1, which contains 0.045 to 0.6% C, 0.07 to 0.15% Cb, and a total of Cb and V of at least 0.22%.

6. A steel product as defined in claim 5, which contains 0.3 to 0.45% Mn.

7. A steel product as defined in claim 6, which contains 0.01 to 0.1% Si, and from 0 to the following maximum percentages of the following elements: 0.015 max. P, 0.02 max. S, 0.01 max. N.

8. A steel product as defined in claim 1, which contains 0.003 to 0.01% N.

* * * * *

UNITED STATES PATENT AND TRADEMARK OFFICE

CERTIFICATE OF CORRECTION

PATENT NO. : 4,142,922

DATED : March 6, 1979

INVENTOR(S) : JOHN K. ABRAHAM and PETER J. VANDER AREND

It is certified that error appears in the above-identified patent and that said Letters Patent are hereby corrected as shown below:

Under OTHER PUBLICATIONS, line 2, delete "Columbrium" and insert — Columbium --.

Abstract, line 4, after "erties" (word part), delete ". With" and insert -- , with --.

Column 2, line 21, after "carbon" and before "the" insert -- and significantly low manganese, while preferably containing very little silicon, e.g. less than 0.1%.

With such proportions of elements, the balance of the steel being iron and incidental substances, the actual numerical ranges for --.

Column 4, line 42, delete "so" and insert -- as --.

Signed and Sealed this

*Sixteenth* Day of *December 1980*

[SEAL]

*Attest:*

SIDNEY A. DIAMOND

*Attesting Officer*

*Commissioner of Patents and Trademarks*